US010083669B2

(12) United States Patent
Cao

(10) Patent No.: US 10,083,669 B2
(45) Date of Patent: Sep. 25, 2018

(54) LIQUID CRYSTAL DISPLAY PANEL COMMON VOLTAGE ADJUSTMENT CIRCUIT AND LIQUID CRYSTAL DISPLAY DEVICE

(71) Applicant: Shenzhen China Star Optoelectronics Technology Co., Ltd., Shenzhen, Guangdong (CN)

(72) Inventor: Dan Cao, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 279 days.

(21) Appl. No.: 14/916,580

(22) PCT Filed: Jan. 6, 2016

(86) PCT No.: PCT/CN2016/070256
§ 371 (c)(1),
(2) Date: Mar. 4, 2016

(87) PCT Pub. No.: WO2017/096686
PCT Pub. Date: Jun. 15, 2017

(65) Prior Publication Data

US 2017/0301307 A1 Oct. 19, 2017

(30) Foreign Application Priority Data

Dec. 7, 2015 (CN) ..... 2015 1 0894344

(51) Int. Cl.
*G09G 5/00* (2006.01)
*G09G 3/36* (2006.01)

(52) U.S. Cl.
CPC ..... *G09G 3/3696* (2013.01); *G09G 3/3648* (2013.01); *G09G 2310/0286* (2013.01);
(Continued)

(58) Field of Classification Search
CPC ..... G09G 3/3655; G09G 2320/0209; G09G 2320/0247; G09G 2310/0291;
(Continued)

(56) References Cited

U.S. PATENT DOCUMENTS

2006/0145995 A1 7/2006 Kim et al.
2012/0162184 A1 6/2012 Kim
(Continued)

FOREIGN PATENT DOCUMENTS

CN 103426443 A 12/2013
CN 103578439 A 2/2014
(Continued)

*Primary Examiner* — Duc Q Dinh
(74) *Attorney, Agent, or Firm* — Andrew C. Cheng

(57) ABSTRACT

The present invention provides a liquid crystal display panel common voltage adjustment circuit and a liquid crystal display device. The liquid crystal display panel common voltage adjustment circuit adjusts a first common voltage applied to a liquid crystal display panel, and comprises a collect unit, a control unit, a feedback unit and an operation adjustment unit, and the collect unit collects a common voltage of the liquid crystal display panel to be a second common voltage, and the control unit receives the second common voltage, and sends a control signal according to a difference value of the second common voltage and a standard common voltage, and the feedback unit outputs a corresponding feedback voltage under control of the control signal, and the operation adjustment unit adjusts the first common voltage according to the feedback voltage, and outputs the first common voltage after adjustment.

14 Claims, 2 Drawing Sheets

(52) U.S. Cl.
CPC ..... *G09G 2310/0289* (2013.01); *G09G 2310/0291* (2013.01)

(58) Field of Classification Search
CPC ..... G09G 2330/04; G09G 2330/06; G09G 3/3614; G09G 2330/02; G09G 2320/043; G09G 2320/02; G09G 2320/0252; G09G 2330/021; G09G 2300/0426; G09G 2310/0289; G09G 2320/0242; G09G 2320/0276; G09G 2370/08
USPC ..... 345/211, 212, 87, 98–100
See application file for complete search history.

(56) References Cited

U.S. PATENT DOCUMENTS

| | | | | |
|---|---|---|---|---|
| 2012/0242641 | A1 | 9/2012 | Lee | |
| 2014/0062990 | A1* | 3/2014 | Zhang | G09G 3/3696 345/212 |

FOREIGN PATENT DOCUMENTS

| | | | |
|---|---|---|---|
| CN | 104050942 | A | 9/2014 |
| JP | H11119743 | A | 4/1999 |
| JP | 2013109095 | A | 6/2013 |
| KR | 100357211 | B1 | 10/2002 |
| KR | 20080012674 | A | 2/2008 |
| KR | 20080022719 | A | 3/2008 |
| KR | 20130005657 | A | 1/2013 |

* cited by examiner

LIQUID CRYSTAL DISPLAY PANEL COMMON VOLTAGE ADJUSTMENT CIRCUIT AND LIQUID CRYSTAL DISPLAY DEVICE

CROSS REFERENCE

This application claims the priority of Chinese Patent Application No. 201510894344.6, entitled "Liquid crystal display panel common voltage adjustment circuit and liquid crystal display device", filed on Dec. 7, 2015, the disclosure of which is incorporated herein by reference in its entirety.

FIELD OF THE INVENTION

The present invention relates to a display panel technology field, and more particularly to a liquid crystal display panel common voltage adjustment circuit and a liquid crystal display device.

BACKGROUND OF THE INVENTION

With the development of the display technology, the liquid crystal display panel possesses properties of small volume and light weight, low power consumption. Therefore, it has been favored by the users. The liquid crystal display device generally comprises the backlight module and the liquid crystal display panel. The backlight module is employed to provide the light for the liquid crystal display panel, and the liquid crystal display panel is employed to show information of words and images. In prior art, as executing the mass production of the liquid crystal panels, one liquid crystal display panel is first selected in general. The common voltage of this liquid crystal display panel is adjusted so that the display quality of the liquid crystal display panel reaches the best. For convenience, the common voltage of the liquid crystal display panel for now is the first common voltage. Then the common voltages of all the liquid crystal display panels in the mass production will be set to be the first common voltage. However, due to the factors with process difference of respective parts of the liquid crystal display panels, the common voltages which are required to be applied to the respective liquid crystal display panels will be different. Namely, as the first common voltage is applied to all the liquid crystal display panels in the mass production, the display qualities of the liquid crystal display panels in the mass production gets poor.

SUMMARY OF THE INVENTION

The present invention provides a liquid crystal display panel common voltage adjustment circuit, wherein the liquid crystal display panel common voltage adjustment circuit is employed to adjust a first common voltage applied to a liquid crystal display panel, and the liquid crystal display panel common voltage adjustment circuit comprises a collect unit, a control unit, a feedback unit and an operation adjustment unit, and the collect unit is employed to collect a common voltage of the liquid crystal display panel to be a second common voltage, and the control unit is employed to receive the second common voltage, and to send a control signal according to a difference value of the second common voltage and a standard common voltage, and the feedback unit outputs a corresponding feedback voltage under control of the control signal, and the operation adjustment unit is employed to adjust the first common voltage according to the feedback voltage, and to output the first common voltage after adjustment, and as the first common voltage after adjustment is applied to the liquid crystal display panel, a display quality of the liquid crystal display panel is the best.

The control unit comprises a control sub unit and a process sub unit, and the control sub unit comprises a first input end, a second input end, a first output end and a second output end, and the control sub unit is employed to calculate the difference value of the second common voltage and the standard common voltage, and to output the same through the first output end and the second output end, and the process sub unit is employed to send the control signal according to the difference value of the second common voltage and the standard common voltage.

The feedback unit comprises a selector, a plurality of first feedback branches and a second feedback branch, and the selector comprises an input end and a plurality of control signal output ends, and the input end of the selector is electrically coupled to the output end of the process sub unit to receive the control signal, and sends a select signal according to the control signal, and all the control signal output ends are coupled to all the first feedback branches correspondingly one by one, and the select signal is employed to selectively activate one first feedback branch and deactivate the rest of the first feedback branches, and the activated first feedback branch cooperates with the second feedback branch to output the feedback voltage.

The selector is a one-out-of-eight selector, and the output end of the selector comprises a first signal input end, a second signal input end and a third signal input end, and the control signal output end of the selector comprises a first control signal output end, a second control signal output end, a third control signal output end, a fourth control signal output end, a fifth control signal output end, a sixth control signal output end, a seventh control signal output end and an eighth control signal output end, and correspondingly, an amount of the first feedback branches is eight, and the first feedback branches are respectively defined to be a first branch, a second branch, a third branch, a fourth branch, a fifth branch, a sixth branch, a seventh branch and an eighth branch, and one ends of the first branch to the eighth branch are respectively coupled to the first control signal output end to the eighth control signal output end correspondingly one by one, and the other ends of the first branch to the eighth branch are coupled to the same node.

The first branch comprises a first resistor and a first thin film transistor, and the second branch comprises a second resistor and a second thin film transistor, and the third branch comprises a third resistor and a third thin film transistor, and the fourth branch comprises a fourth resistor and a fourth thin film transistor, and the fifth branch comprises a fifth resistor and a fifth thin film transistor, and the sixth branch comprises a sixth resistor and a sixth thin film transistor, and the seventh branch comprises a seventh resistor and a seventh thin film transistor, and the eighth branch comprises an eighth thin film transistor, and sources of the respective thin film transistors are coupled, and gates of the first thin film transistor to the eighth thin film transistor are respectively and correspondingly coupled to the first control signal output end to the eighth control signal output end, and drains of the first thin film transistor to the eighth thin film transistor are respectively and correspondingly coupled to one end of the resistor in the branch where the thin film transistor is, and the other ends of the resistors in the respective branches are coupled, together and coupled to the drain of the eighth thin film transistor.

Resistances of the first resistor, the second resistor, the third resistor, the fourth resistor, the fifth resistor, the sixth resistor and the seventh resistor differ from one another.

The control sub unit further comprises a third output end, and the control sub unit is further employed to generate a third common voltage according to the difference value of the second common voltage and the standard common voltage, and the third common voltage is outputted through the third output end, and the second feedback branch comprises an eighth resistor, and one end of the eighth resistor is coupled to the third output end, and the other end is coupled to the drain of the eighth thin film transistor.

As the control signals received by the first signal input end, the second signal input end and the third input end are 000 in order, the select signal activates the first branch, and the rest of the first feedback branches are deactivated; as the control signals received by the first signal input end, the second signal input end and the third input end are 001 in order, the select signal activates the second branch, and the rest of the first feedback branches are deactivated; as the control signals received by the first signal input end, the second signal input end and the third input end are 010 in order, the select signal activates the third branch, and the rest of the first feedback branches are deactivated; as the control signals received by the first signal input end, the second signal input end and the third input end are 011 in order, the select signal activates the fourth branch, and the rest of the first feedback branches are deactivated; as the control signals received by the first signal input end, the second signal input end and the third input end are 100 in order, the select signal activates the fifth branch, and the rest of the first feedback branches are deactivated;

as the control signals received by the first signal input end, the second signal input end and the third input end are 101 in order, the select signal activates the sixth branch, and the rest of the first feedback branches are deactivated; as the control signals received by the first signal input end, the second signal input end and the third input end are 110 in order, the select signal activates the seventh branch, and the rest of the first feedback branches are deactivated; as the control signals received by the first signal input end, the second signal input end and the third input end are 111 in order, the select signal activates the eighth branch, and the rest of the first feedback branches are deactivated.

The operation adjustment unit comprises a shift register and an operational amplifier, and an input end of the shift register receives a reference voltage, and an output end of the shift register is coupled to the operational amplifier, and the operational amplifier comprises a first end, a second end and a third end, and the first end and the second end are input ends of the operational amplifier, and the third end is an output end of the operational amplifier, and the first end is coupled to the output end of the shift register, and the second end is coupled to the first feedback branches and the second feedback branch to receive the feedback voltage, and the third end is coupled to the first feedback branches to output the first common voltage after adjustment.

In comparison with prior art, the liquid crystal display panel common voltage adjustment circuit of the present invention is employed to adjust the first common voltage applied to the liquid crystal display panel. The liquid crystal display panel common voltage adjustment circuit of the present invention comprises the collect unit, the control unit, the feedback unit and the operation adjustment unit. The common voltage of the liquid crystal display panel collected by the collect unit is the second common voltage, and the control unit sends the control signal according to the difference value of the second common voltage and a standard common voltage. The feedback unit outputs the corresponding feedback voltage under control of the control signal, and the operation adjustment unit adjusts the first common voltage according to the feedback voltage, and outputs the first common voltage after adjustment, and as the first common voltage after adjustment is applied to the liquid crystal display panel, the display quality of the liquid crystal display panel is the best. Accordingly, the liquid crystal display panel common voltage adjustment circuit of the present invention can adjust the common voltage applied to the liquid crystal display panel for various liquid crystal display panels, and applies proper common voltage to the respective liquid crystal display panel as executing the mass production of the liquid crystal panels for making the best display quality of the liquid crystal panels.

The present invention further provides a liquid crystal display device. The liquid crystal display device comprises any one of the aforesaid liquid crystal display panel common voltage adjustment circuits.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Embodiments of the present invention are described in detail with the technical matters, structural features, achieved objects, and effects with reference to the accompanying drawings as follows. It is clear that the described embodiments are part of embodiments of the present invention, but not all embodiments. Based on the embodiments of the present invention, all other embodiments to those of ordinary skill in the premise of no creative efforts obtained, should be considered within the scope of protection of the present invention.

Figure 1:
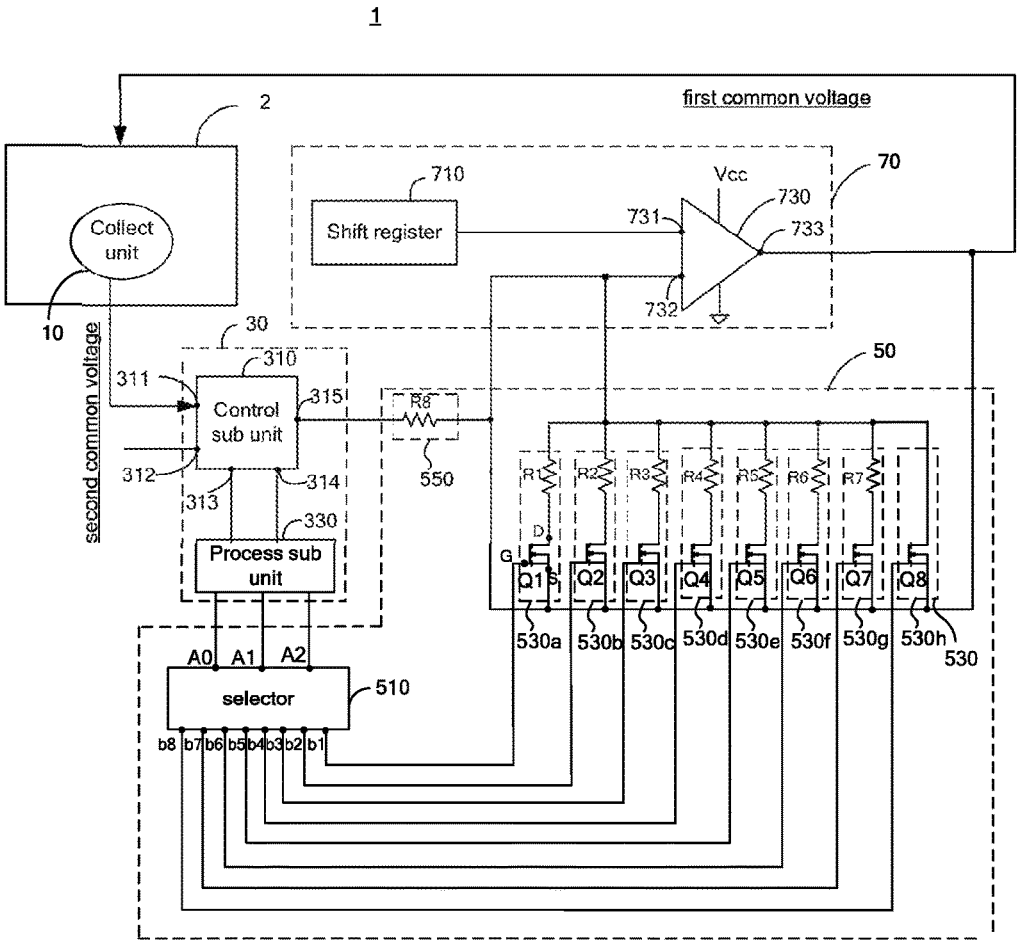
FIG. 1 is a circuit structure diagram of a liquid crystal display panel common voltage adjustment circuit according to one preferred embodiment of the present invention.

Please refer to FIG. 1. FIG. 1 is a circuit structure diagram of a liquid crystal display panel common voltage adjustment circuit according to one preferred embodiment of the present invention. The liquid crystal display panel common voltage adjustment circuit 1 is employed to adjust a first common voltage applied to a liquid crystal display panel, and the liquid crystal display panel common voltage adjustment circuit 1 comprises a collect unit 10, a control unit 30, a feedback unit 50 and an operation adjustment unit 70. The collect unit 10 is employed to collect a common voltage of the liquid crystal display panel 2 to be a second common voltage. The control unit 30 is electrically coupled to the collect unit 10, and the control unit 30 is employed to receive the second common voltage, and to send a control signal according to a difference value of the second common voltage and a standard common voltage of a display region of the liquid crystal display panel 2. The feedback unit 50 outputs a corresponding feedback voltage under control of the control signal. The operation adjustment unit 70 is employed to adjust the first common voltage according to the feedback voltage, and to output the first common voltage after adjustment, and as the first common voltage after adjustment is applied to the liquid crystal display panel, a display quality of the liquid crystal display panel 2 is the best. The display quality of the liquid crystal display panel 2 includes the display uniformity, the image residue degree, and the flicker degree as the liquid crystal display panel 2 shows images. Preferably, the collection unit 10 collects the common voltage of the display region, of which the display quality is the worst in the liquid crystal display panel 2.

The control unit 30 comprises a control sub unit 310 and a process sub unit 330. The control sub unit 310 comprises a first input end 311, a second input end 312, a first output end 313 and a second output end 314. The first input end 311 receives the second common voltage, and the second input end 312 receives the standard common voltage, and the first output end 313 and the second output end 314 are coupled to the process sub unit 330, and the control sub unit 310 is employed to calculate the difference value of the second common voltage and the standard common voltage, and to output the same through the first output end 313 and the second output end 314. The process sub unit 330 is employed to send the control signal according to the difference value of the second common voltage and the standard common voltage.

The feedback unit 50 comprises a selector 510, a plurality of first feedback branches 530 and a second feedback branch 550. The selector 510 comprises an input end and a plurality of control signal output ends, and the input end of the selector 510 is electrically coupled to the output end of the process sub unit 330 to receive the control signal, and sends a select signal according to the control signal, and all the control signal output ends are coupled to all the first feedback branches 530 correspondingly one by one, and the select signal is employed to selectively activate one first feedback branch 530 and deactivate the rest of the first feedback branches 530, and the activated first feedback branch 530 cooperates with the second feedback branch 550 to output the feedback voltage.

In this embodiment, the selector 510 is a one-out-of-eight selector, and the selector comprises three input ends. For convenience, these three input ends are respectively named to be a first signal input end A0, a second signal input end A1 and a third signal input end A2, and the control signal output end of the selector 510 comprises a first control signal output end b1, a second control signal output end b2, a third control signal output end b3, a fourth control signal output end b4, a fifth control signal output end b5, a sixth control signal output end b6, a seventh control signal output end b7 and an eighth control signal output end b8. Correspondingly, an amount of the first feedback branches 530 is eight, and the first feedback branches are respectively defined to be a first branch 530*a*, a second branch 530*b*, a third branch 530*c*, a fourth branch 530*d*, a fifth branch 530*e*, a sixth branch 530*f*, a seventh branch 530*g* and an eighth branch 530*h*. One ends of the first branch 530*a* to the eighth branch 530*h* are respectively coupled to the first control signal output end b1 to the eighth control signal output end b8 correspondingly one by one, and the other ends of the first branch 530*a* to the eighth branch 530*h* are coupled to the same node.

Specifically, one end of the first branch 530*a* is coupled to the first control signal output end b1, and the second branch 530*b* is coupled to the second control signal output end b2, and the third branch 530*c* is coupled to the third control signal output end b3, and the fourth branch 530*d* is coupled to the fourth control signal output end b4, and the fifth branch 530*e* is coupled to the fifth control signal output end b5, and the sixth branch 530*f* is coupled to the sixth control signal output end b6, and the seventh branch 530*g* is coupled to the seventh control signal output end b7, and the eighth branch 530*h* is coupled to the eighth control signal output end b8. The other ends of the first branch 530*a*, the second branch 530*b*, the third branch 530*c*, the fourth branch 530*d*, the fifth branch 530*e*, the sixth branch 530*f*, the seventh branch 530*g* and the eighth branch 530*h* are coupled to the same node.

The first branch 530*a* comprises a first resistor R1 and a first thin film transistor Q1, and the second branch 530*b* comprises a second resistor R2 and a second thin film transistor Q2, and the third branch 530*c* comprises a third resistor R3 and a third thin film transistor Q3, and the fourth branch 530*d* comprises a fourth resistor R4 and a fourth thin film transistor Q4, and the fifth branch 530*e* comprises a fifth resistor R5 and a fifth thin film transistor Q5, and the sixth branch 530*f* comprises a sixth resistor R6 and a sixth thin film transistor Q6, and the seventh branch 530*g* comprises a seventh resistor R7 and a seventh thin film transistor Q7, and the eighth branch 530*h* comprises an eighth thin film transistor Q8. Each of the thin film transistors comprises a Gate, a Source and a Drain. For convenience of marking, the gate is indicated with G, and the source is indicated with S, and the drain is indicated with D in figures. The sources of the respective thin film transistors are coupled, and gates of the first thin film transistor Q1 to the eighth thin film transistor Q8 are respectively and correspondingly coupled to the first control signal output end b1 to the eighth control signal output end b8, and drains of the first thin film transistor Q1 to the eighth thin film transistor Q8 are respectively and correspondingly coupled to one end of the resistor in the branch where the thin film transistor is, and the other ends of the resistors in the respective branches are coupled, together and coupled to the drain of the eighth thin film transistor Q8. In other words, the source of the first thin film transistor Q1, the source of the second thin film transistor Q2, the source of the third thin film transistor Q3, the source of the fourth thin film transistor Q4, the source of the fifth thin film transistor Q5, the source of the sixth thin film transistor Q6, the source of the seventh thin film transistor Q7 and the source of the eighth thin film transistor Q8 are coupled to the same node. The gate of the first thin film transistor Q1 is electrically coupled to the first control signal output end b1, and the gate of the second thin film transistor Q2 is electrically coupled to the second control signal output end b2, and the gate of the third thin film transistor Q3 is electrically coupled to the third control signal output end b3, and the gate of the source of the fourth thin film transistor Q4 is electrically coupled to the fourth control signal output end b4, and the gate of the fifth thin film transistor Q5 is electrically coupled to the fifth control signal output end b5, and the gate of the sixth thin film transistor Q6 is electrically coupled to the sixth control signal output end b6, and the gate of the seventh thin film transistor Q7 is electrically coupled to the seventh control signal output end b1, and the gate of the eighth thin film transistor Q8 is electrically coupled to the eighth control signal output end b8. The drain of the first thin film transistor Q1 is electrically coupled to one end of the first resistor R1, and the drain of the second thin film transistor Q2 is electrically coupled to one end of the second resistor R2, and the drain of the third thin film transistor Q3 is electrically coupled to one end of the third resistor R3, and the drain of the source of the fourth thin film transistor Q4 is electrically coupled to one end of the fourth resistor R4, and the drain of the fifth thin film transistor Q5 is electrically coupled to one end of the fifth resistor R5, and the drain of the sixth thin film transistor Q6 is electrically coupled to one end of the sixth resistor R6, and the drain of the seventh thin film transistor Q7 is electrically coupled to one end of the seventh resistor R7. The other ends of the first resistor R1, the second resistor R2, the third resistor R3, the fourth resistor R4, the fifth resistor R5, the sixth resistor R6, the seventh resistor R7 and the drain of the eighth thin film transistor Q8 are coupled to the same node.

The resistances of the first resistor R1, the second resistor R2, the third resistor R3, the fourth resistor R4, the fifth resistor R5, the sixth resistor R6 and the seventh resistor R7 differ from one another.

One end of the second feedback branch 550 is coupled to the control sub unit 310, and the other end is coupled to the respective first feedback branches 530. Specifically, the second feedback branch 550 comprises an eighth resistor R8, and correspondingly, the control sub unit 310 further comprises a third output end 315, and the control sub unit 310 is further employed to generate a third common voltage according to the difference value of the second common voltage and the standard common voltage, and the third common voltage is outputted through the third output end 315. One end of the eighth resistor R8 is coupled to the third output end 315, and the other end is coupled to the drain of the eighth thin film transistor Q8.

As the control signals received by the first signal input end A0, the second signal input end A1 and the third input end A2 are 000 in order, the select signal activates the first branch 530*a*, and the rest of the first feedback branches are deactivated. In other words, as the control signals received by the first signal input end A0, the second signal input end A1 and the third input end A2 are 000 in order, the select signal activates the first branch 530*a*, and the second branch 530*b*, the third branch 530*c*, the fourth branch 530*d*, the fifth branch 530*e*, the sixth branch 530*f*, the seventh branch 530*g* and the eighth branch 530*h* are deactivated. Correspondingly, as the control signals received by the first signal input end A0, the second signal input end A1 and the third input end A2 are 001 in order, the select signal activates the second branch 530*b*, and the rest of the first feedback branches are deactivated. As the control signals received by the first signal input end A0, the second signal input end A1 and the third input end A2 are 010 in order, the select signal activates the third branch 530*c*, and the rest of the first feedback branches are deactivated. As the control signals received by the first signal input end A0, the second signal input end A1 and the third input end A2 are 011 in order, the select signal activates the fourth branch 530*d*, and the rest of the first feedback branches are deactivated. As the control signals received by the first signal input end A0, the second signal input end A1 and the third input end A2 are 100 in order, the select signal activates the fifth branch 530*e*, and the rest of the first feedback branches are deactivated. As the control signals received by the first signal input end A0, the second signal input end A1 and the third input end A2 are 101 in order, the select signal activates the sixth branch 530*f*, and the rest of the first feedback branches are deactivated. As the control signals received by the first signal input end A0, the second signal input end A1 and the third input end A2 are 110 in order, the select signal activates the seventh branch 530*g*, and the rest of the first feedback branches are deactivated. As the control signals received by the first signal input end A0, the second signal input end A1 and the third input end A2 are 111 in order, the select signal activates the eighth branch 530*h*, and the rest of the first feedback branches are deactivated.

The operation adjustment unit 70 comprises a shift register 710 and an operational amplifier 730. In this embodiment, the shift register 710 is an eight digitals shift register, and an input end of the shift register 710 receives a reference voltage VREF, and an output end of the shift register 710 is coupled to the operational amplifier 730. The operational amplifier 730 comprises a first end 731, a second end 732 and a third end 733. The first end 731 and the second end 732 are input ends of the operational amplifier 730, and the third end 733 is an output end of the operational amplifier 730, and the first end 731 is coupled to the output end of the shift register 710, and the second end 732 is coupled to the first feedback branches 530 and the second feedback branch 550 to receive the feedback voltage. Specifically, the second end 732 is coupled to a node between the eighth resistor R8 and the drain of the eighth thin film transistor Q8. The third end 733 is coupled to the first feedback branches 530 to output the first common voltage after adjustment. Specifically, the third end 733 is coupled to the sources of the respective thin film transistors in the first feedback branches.

Figure 2:
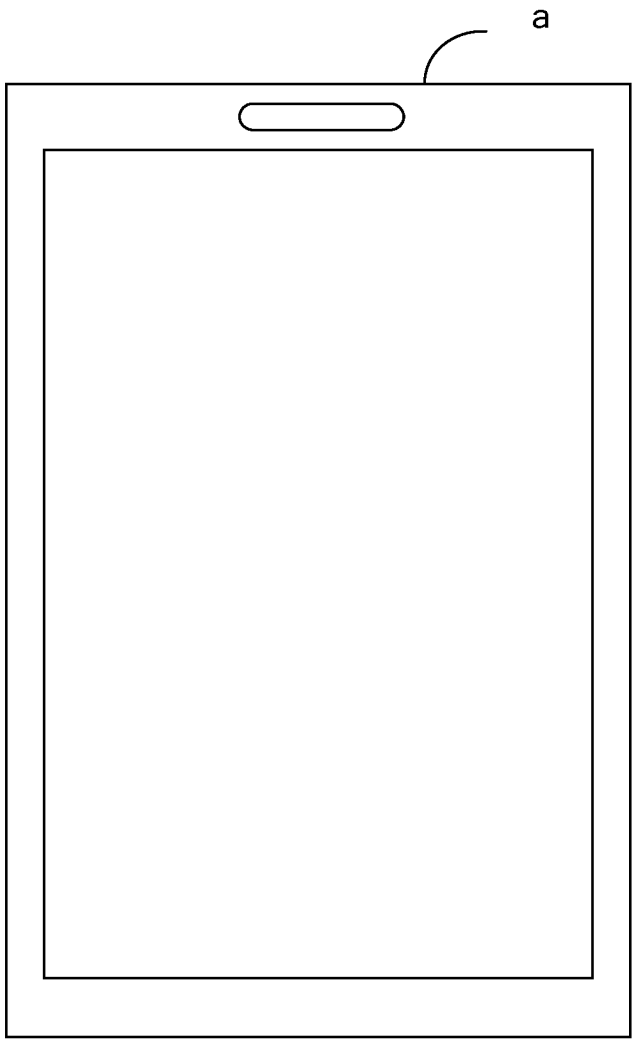
FIG. 2 is a structure diagram of a liquid crystal display device according to one preferred embodiment of the present invention.

In comparison with prior art, the liquid crystal display panel common voltage adjustment circuit 1 of the present invention is employed to adjust the first common voltage applied to the liquid crystal display panel 2. The liquid crystal display panel common voltage adjustment circuit 1 comprises the collect unit 10, the control unit 30, the feedback unit 50 and the operation adjustment unit 70. The common voltage of the liquid crystal display panel 2 collected by the collect unit 30 is the second common voltage, and the control unit 30 receives second common voltage and sends the control signal according to the difference value of the second common voltage and a standard common voltage of the display region of the liquid crystal display panel 2. The feedback unit outputs the corresponding feedback voltage under control of the control signal, and the operation adjustment unit adjusts the first common voltage according to the feedback voltage, and outputs the first common voltage after adjustment, and as the first common voltage after adjustment is applied to the liquid crystal display panel, the display quality of the liquid crystal display panel is the best. Accordingly, the liquid crystal display panel common voltage adjustment circuit 1 of the present invention can adjust the common voltage applied to the liquid crystal display panel 2 for various liquid crystal display panels 2, and applies proper common voltage to the respective liquid crystal display panel 2 as executing the mass production of the liquid crystal panels 2 for making the best display quality of the liquid crystal panels 2. The present invention further provides a liquid crystal display device a. Please refer to FIG. 2. FIG. 2 is a structure diagram of a liquid crystal display device according to one preferred embodiment of the present invention. The liquid crystal display device a comprises the aforesaid liquid crystal display panel common voltage adjustment circuit, and the repeated description is omitted here. In this embodiment, the liquid crystal display device a comprises the smart phone, the mobile internet device (MID), the electronic book, the tablet, the Play Station Portable (PSP) or Personal Digital Assistant (PDA) but not limited thereto.

Above are embodiments of the present invention, which does not limit the scope of the present invention. Any modifications, equivalent replacements or improvements within the spirit and principles of the embodiment described above should be covered by the protected scope of the invention.

What is claimed is:

1. A liquid crystal display panel common voltage adjustment circuit, wherein the liquid crystal display panel common voltage adjustment circuit is employed to adjust a first common voltage applied to a liquid crystal display panel, and the liquid crystal display panel common voltage adjustment circuit comprises a collect unit, a control unit, a feedback unit and an operation adjustment unit, and the collect unit is employed to collect a common voltage of the liquid crystal display panel to be a second common voltage, and the control unit is employed to receive the second common voltage, and to send a control signal according to a difference value of the second common voltage and a standard common voltage, and the feedback unit outputs a corresponding feedback voltage under control of the control signal, and the operation adjustment unit is employed to adjust the first common voltage according to the feedback voltage, and to output the first common voltage after adjustment, and as the first common voltage after adjustment is applied to the liquid crystal display panel, a display quality of the liquid crystal display panel is the best, wherein the control unit comprises a control sub unit and a process sub unit, and the control sub unit comprises a first input end, a second input end, a first output end and a second output end, and the control sub unit is employed to calculate the difference value of the second common voltage and the standard common voltage, and to output the same through the first output end and the second output end, and the process sub unit is employed to send the control signal according to the difference value of the second common voltage and the standard common voltage, wherein the feedback unit comprises a selector, a plurality of first feedback branches and a second feedback branch, and the selector comprises an input end and a plurality of control signal output ends, and the input end of the selector is electrically coupled to the output end of the process sub unit to receive the control signal, and sends a select signal according to the control signal, and all the control signal output ends are coupled to all the first feedback branches correspondingly one by one, and the select signal is employed to selectively activate one first feedback branch and deactivate the rest of the first feedback branches, and the activated first feedback branch cooperates with the second feedback branch to output the feedback voltage.

2. The liquid crystal display panel common voltage adjustment circuit according to claim 1, wherein the selector is a one-out-of-eight selector, and the output end of the selector comprises a first signal input end, a second signal input end and a third signal input end, and the control signal output end of the selector comprises a first control signal output end, a second control signal output end, a third control signal output end, a fourth control signal output end, a fifth control signal output end, a sixth control signal output end, a seventh control signal output end and an eighth control signal output end, and correspondingly, an amount of the first feedback branches is eight, and the first feedback branches are respectively defined to be a first branch, a second branch, a third branch, a fourth branch, a fifth branch, a sixth branch, a seventh branch and an eighth branch, and one ends of the first branch to the eighth branch are respectively coupled to the first control signal output end to the eighth control signal output end correspondingly one by one, and the other ends of the first branch to the eighth branch are coupled to the same node.

3. The liquid crystal display panel common voltage adjustment circuit according to claim 2, wherein the first branch comprises a first resistor and a first thin film transistor, and the second branch comprises a second resistor and a second thin film transistor, and the third branch comprises a third resistor and a third thin film transistor, and the fourth branch comprises a fourth resistor and a fourth thin film transistor, and the fifth branch comprises a fifth resistor and a fifth thin film transistor, and the sixth branch comprises a sixth resistor and a sixth thin film transistor, and the seventh branch comprises a seventh resistor and a seventh thin film transistor, and the eighth branch comprises an eighth thin film transistor, and sources of the respective thin film transistors are coupled, and gates of the first thin film transistor to the eighth thin film transistor are respectively and correspondingly coupled to the first control signal output end to the eighth control signal output end, and drains of the first thin film transistor to the eighth thin film transistor are respectively and correspondingly coupled to one end of the resistor in the branch where the thin film transistor is, and the other ends of the resistors in the respective branches are coupled, together and coupled to the drain of the eighth thin film transistor.

4. The liquid crystal display panel common voltage adjustment circuit according to claim 3, wherein resistances of the first resistor, the second resistor, the third resistor, the fourth resistor, the fifth resistor, the sixth resistor and the seventh resistor differ from one another.

5. The liquid crystal display panel common voltage adjustment circuit according to claim 3, wherein the control sub unit further comprises a third output end, and the control sub unit is further employed to generate a third common voltage according to the difference value of the second common voltage and the standard common voltage, and the third common voltage is outputted through the third output end, and the second feedback branch comprises an eighth resistor, and one end of the eighth resistor is coupled to the third output end, and the other end is coupled to the drain of the eighth thin film transistor.

6. The liquid crystal display panel common voltage adjustment circuit according to claim 5, wherein as the control signals received by the first signal input end, the second signal input end and the third input end are 000 in order, the select signal activates the first branch, and the rest of the first feedback branches are deactivated; as the control signals received by the first signal input end, the second signal input end and the third input end are 001 in order, the select signal activates the second branch, and the rest of the first feedback branches are deactivated; as the control signals received by the first signal input end, the second signal input end and the third input end are 010 in order, the select signal activates the third branch, and the rest of the first feedback branches are deactivated; as the control signals received by the first signal input end, the second signal input end and the third input end are 011 in order, the select signal activates the fourth branch, and the rest of the first feedback branches are deactivated; as the control signals received by the first signal input end, the second signal input end and the third input end are 100 in order, the select signal activates the fifth branch, and the rest of the first feedback branches are deactivated; as the control signals received by the first signal input end, the second signal input end and the third input end are 101 in order, the select signal activates the sixth branch, and the rest of the first feedback branches are deactivated; as the control signals received by the first signal input end, the second signal input end and the third input end are 110 in order, the select signal activates the seventh branch, and the rest of the first feedback branches are deactivated; as the control signals received by the first signal input end, the second signal input end and the third input end are 111 in order, the select signal activates the eighth branch, and the rest of the first feedback branches are deactivated.

7. The liquid crystal display panel common voltage adjustment circuit according to claim 6, wherein the operation adjustment unit comprises a shift register and an operational amplifier, and an input end of the shift register receives a reference voltage, and an output end of the shift register is coupled to the operational amplifier, and the operational amplifier comprises a first end, a second end and a third end, and the first end and the second end are input ends of the operational amplifier, and the third end is an output end of the operational amplifier, and the first end is coupled to the output end of the shift register, and the second end is coupled to the first feedback branches and the second feedback branch to receive the feedback voltage, and the third end is coupled to the first feedback branches to output the first common voltage after adjustment.

8. A liquid crystal display device, wherein the liquid crystal display device comprises a liquid crystal display panel common voltage adjustment circuit, and the liquid crystal display panel common voltage adjustment circuit is employed to adjust a first common voltage applied to a liquid crystal display panel, and the liquid crystal display panel common voltage adjustment circuit comprises a collect unit, a control unit, a feedback unit and an operation adjustment unit, and the collect unit is employed to collect a common voltage of the liquid crystal display panel to be a second common voltage, and the control unit is employed to receive the second common voltage, and to send a control signal according to a difference value of the second common voltage and a standard common voltage, and the feedback unit outputs a corresponding feedback voltage under control of the control signal, and the operation adjustment unit is employed to adjust the first common voltage according to the feedback voltage, and to output the first common voltage after adjustment, and as the first common voltage after adjustment is applied to the liquid crystal display panel, a display quality of the liquid crystal display panel is the best, wherein the control unit comprises a control sub unit and a process sub unit, and the control sub unit comprises a first input end, a second input end, a first output end and a second output end, and the control sub unit is employed to calculate the difference value of the second common voltage and the standard common voltage, and to output the same through the first output end and the second output end, and the process sub unit is employed to send the control signal according to the difference value of the second common voltage and the standard common voltage, wherein the feedback unit comprises a selector, a plurality of first feedback branches and a second feedback branch, and the selector comprises an input end and a plurality of control signal output ends, and the input end of the selector is electrically coupled to the output end of the process sub unit to receive the control signal, and sends a select signal according to the control signal, and all the control signal output ends are coupled to all the first feedback branches correspondingly one by one, and the select signal is employed to selectively activate one first feedback branch and deactivate the rest of the first feedback branches, and the activated first feedback branch cooperates with the second feedback branch to output the feedback voltage.

9. The liquid crystal display device according to claim 8, wherein the selector is a one-out-of-eight selector, and the output end of the selector comprises a first signal input end, a second signal input end and a third signal input end, and the control signal output end of the selector comprises a first control signal output end, a second control signal output end, a third control signal output end, a fourth control signal output end, a fifth control signal output end, a sixth control signal output end, a seventh control signal output end and an eighth control signal output end, and correspondingly, an amount of the first feedback branches is eight, and the first feedback branches are respectively defined to be a first branch, a second branch, a third branch, a fourth branch, a fifth branch, a sixth branch, a seventh branch and an eighth branch, and one ends of the first branch to the eighth branch are respectively coupled to the first control signal output end to the eighth control signal output end correspondingly one by one, and the other ends of the first branch to the eighth branch are coupled to the same node.

10. The liquid crystal display device according to claim 9, wherein the first branch comprises a first resistor and a first thin film transistor, and the second branch comprises a second resistor and a second thin film transistor, and the third branch comprises a third resistor and a third thin film transistor, and the fourth branch comprises a fourth resistor and a fourth thin film transistor, and the fifth branch comprises a fifth resistor and a fifth thin film transistor, and the sixth branch comprises a sixth resistor and a sixth thin film transistor, and the seventh branch comprises a seventh resistor and a seventh thin film transistor, and the eighth branch comprises an eighth thin film transistor, and sources of the respective thin film transistors are coupled, and gates of the first thin film transistor to the eighth thin film transistor are respectively and correspondingly coupled to the first control signal output end to the eighth control signal output end, and drains of the first thin film transistor to the eighth thin film transistor are respectively and correspondingly coupled to one end of the resistor in the branch where the thin film transistor is, and the other ends of the resistors in the respective branches are coupled, together and coupled to the drain of the eighth thin film transistor.

11. The liquid crystal display device according to claim 10, wherein resistances of the first resistor, the second resistor, the third resistor, the fourth resistor, the fifth resistor, the sixth resistor and the seventh resistor differ from one another.

12. The liquid crystal display device according to claim 10, wherein the control sub unit further comprises a third output end, and the control sub unit is further employed to generate a third common voltage according to the difference value of the second common voltage and the standard common voltage, and the third common voltage is outputted through the third output end, and the second feedback branch comprises an eighth resistor, and one end of the eighth resistor is coupled to the third output end, and the other end is coupled to the drain of the eighth thin film transistor.

13. The liquid crystal display device according to claim, wherein as the control signals received by the first signal input end, the second signal input end and the third input end are 000 in order, the select signal activates the first branch, and the rest of the first feedback branches are deactivated; as the control signals received by the first signal input end, the second signal input end and the third input end are 001 in order, the select signal activates the second branch, and the rest of the first feedback branches are deactivated; as the control signals received by the first signal input end, the second signal input end and the third input end are 010 in order, the select signal activates the third branch, and the rest of the first feedback branches are deactivated; as the control signals received by the first signal input end, the second signal input end and the third input end are 011 in order, the select signal activates the fourth branch, and the rest of the first feedback branches are deactivated; as the control signals received by the first signal input end, the second signal input end and the third input end are 100 in order, the select signal activates the fifth branch, and the rest of the first feedback branches are deactivated; as the control signals received by the first signal input end, the second signal input end and the third input end are 101 in order, the select signal activates the sixth branch, and the rest of the first feedback branches are deactivated; as the control signals received by the first signal input end, the second signal input end and the third input end are 110 in order, the select signal activates the seventh branch, and the rest of the first feedback branches are deactivated; as the control signals received by the first signal input end, the second signal input end and the third input end are 111 in order, the select signal activates the eighth branch, and the rest of the first feedback branches are deactivated.

14. The liquid crystal display device according to claim 13, wherein the operation adjustment unit comprises a shift register and an operational amplifier, and an input end of the shift register receives a reference voltage, and an output end of the shift register is coupled to the operational amplifier, and the operational amplifier comprises a first end, a second end and a third end, and the first end and the second end are input ends of the operational amplifier, and the third end is an output end of the operational amplifier, and the first end is coupled to the output end of the shift register, and the second end is coupled to the first feedback branches and the second feedback branch to receive the feedback voltage, and the third end is coupled to the first feedback branches to output the first common voltage after adjustment.

* * * * *